United States Patent [19]

Oeda

[11] 4,090,158

[45] May 16, 1978

[54] CIRCUIT BREAKER

[76] Inventor: Komao Oeda, 21-17, Todoroki-7-chome, Setagaya-ku, Tokyo, Japan

[21] Appl. No.: 747,224

[22] Filed: Dec. 3, 1976

[30] Foreign Application Priority Data

Dec. 24, 1975 Japan ..... 50-173626[U]

[51] Int. Cl.[2] ..... H01H 73/12

[52] U.S. Cl. ..... 335/17; 335/25; 335/26

[58] Field of Search ..... 335/17, 156, 25, 26, 335/27

[56] References Cited

U.S. PATENT DOCUMENTS

| | | | |
|---|---|---|---|
| 2,343,548 | 3/1944 | Graves, Jr. | 335/17 |
| 3,083,359 | 3/1963 | Smith | 335/17 |
| 3,365,682 | 1/1968 | Fujita | 335/17 |
| 3,388,357 | 6/1968 | Lawson et al. | 335/17 |

*Primary Examiner*—Harold Broome

*Attorney, Agent, or Firm*—Armstrong, Nikaido, Marmelstein & Kubovcik

[57] ABSTRACT

A circuit breaker comprising stationary contact means connected to power source terminal means, load terminal means, a movable lever swingably supported at a portion thereof and having, at one free end thereof, movable contact means connected to the load terminal means and normally brought into contact with the stationary contact means, current sensing means for producing a first signal when detecting an overload current and a second signal when detecting a short-circuit current, overload current responsive means for separating the movable contact means of the movable lever from the stationary contact means in response to the first signal, short-circuit current responsive means for actuating the overload current responsive means in response to the second signal, means for effecting a short-circuit indication in response to actuation of the short-circuit current responsive means, and means for holding the actuation of the short-circuit current responsive means in response to actuation of the short-circuit current responsive means.

9 Claims, 5 Drawing Figures

CIRCUIT BREAKER

BACKGROUND OF THE INVENTION

1. Field of the Invention

This invention relates to a circuit breaker for breaking an electrical circuit by detecting an overload current and a short-circuit current therein, and more particularly relates to a circuit breaker capable of effecting a short-circuit indication and preventing the circuit breaker from being thrown on again when short-circuits occur in the circuit.

2. Description of the Prior Art

In general, a circuit breaker automatically breaks the circuit for various causes including short-circuits, overload currents, starting rush currents to loaded apparatus, mechanical shocks imparted upon the circuit breaker and so on. Once the circuit breaker is broken, some types of load require an immediate recovery from the power failure so that it is often attempted to throw on the circuit breaker forcibly. If an operator forcibly throws on the circuit breaker without knowing that the circuit is turned off for short-circuit causes, there sometimes arises an accident that the operator gets burnt in the hand or the circuit breaker is damaged.

SUMMARY OF THE INVENTION

One object of the invention is to eliminate the aforementioned disadvantages of a conventional circuit breaker.

Another object of the invention is to provide an improved circuit breaker capable of indicating the occurrence of short-circuits in the circuit and preventing the circuit breaker from being thrown on again by locking it, when the circuit breaker is broken for short-circuit causes.

DETAILED DESCRIPTION OF THE PREFERRED EMBODIMENTS

Figure 1:
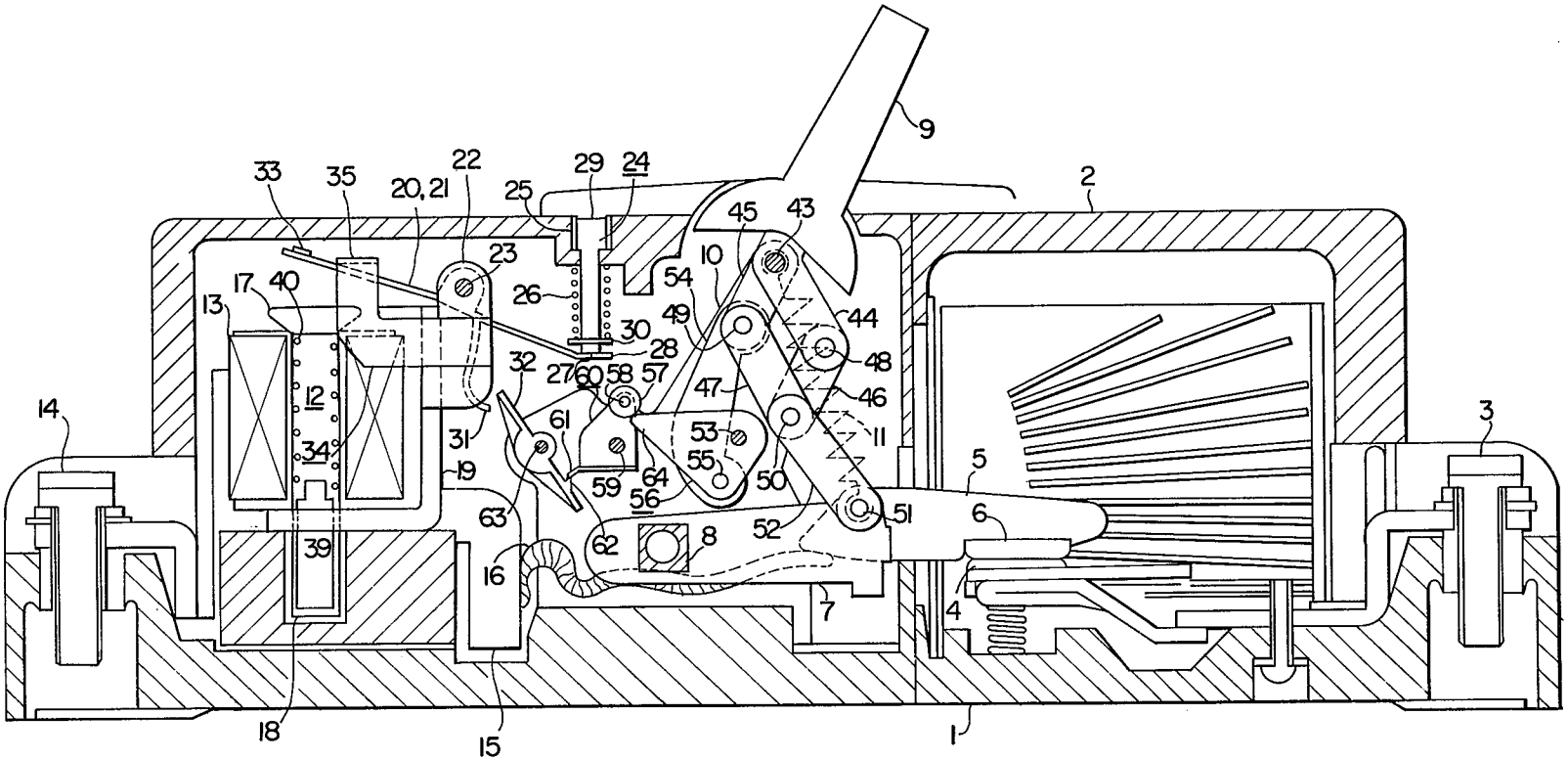
FIGS. 1, 2 and 3 are longitudinal sectional views of a circuit breaker embodying the invention.
Figure 2:
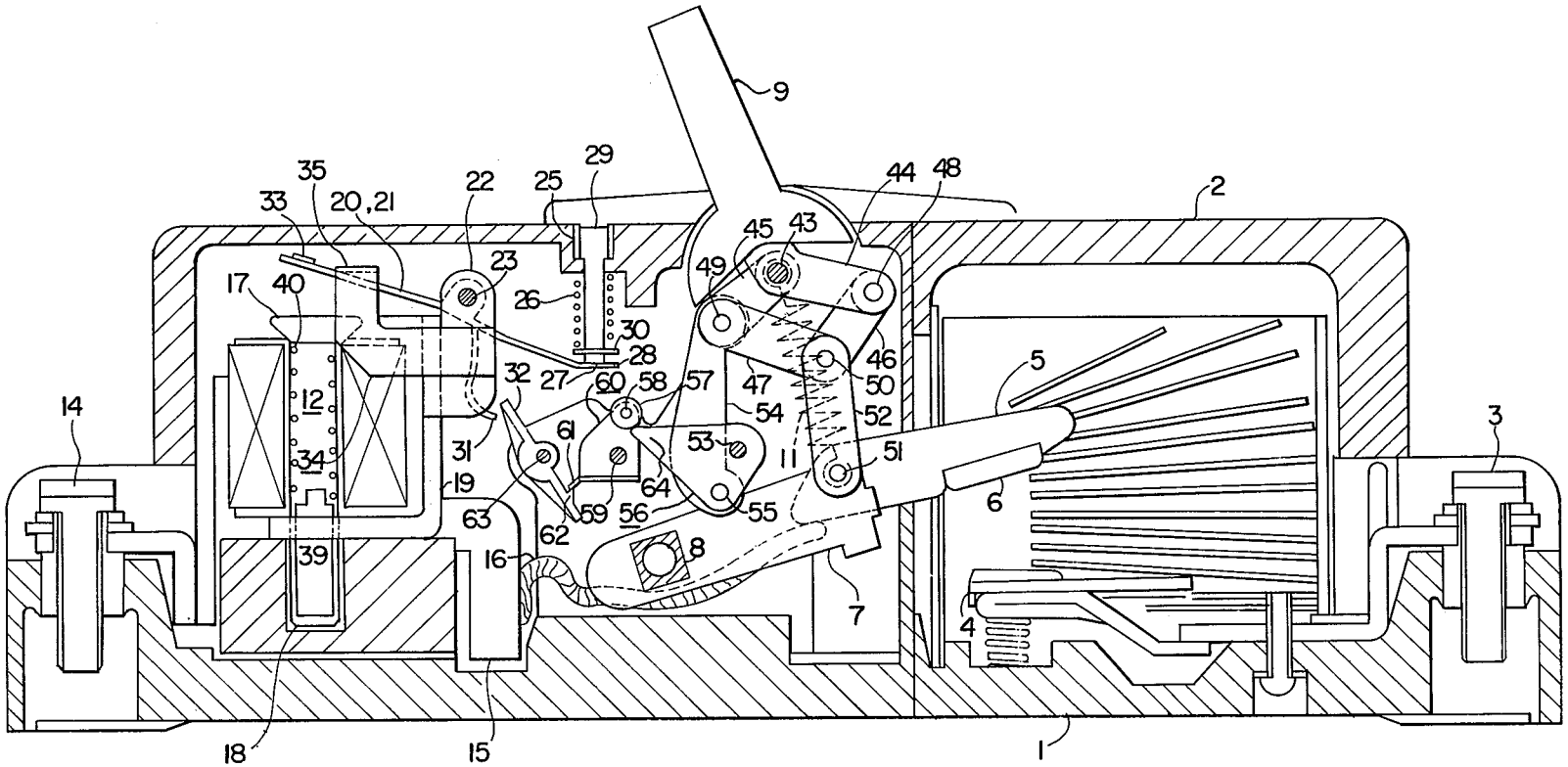
Figure 3:
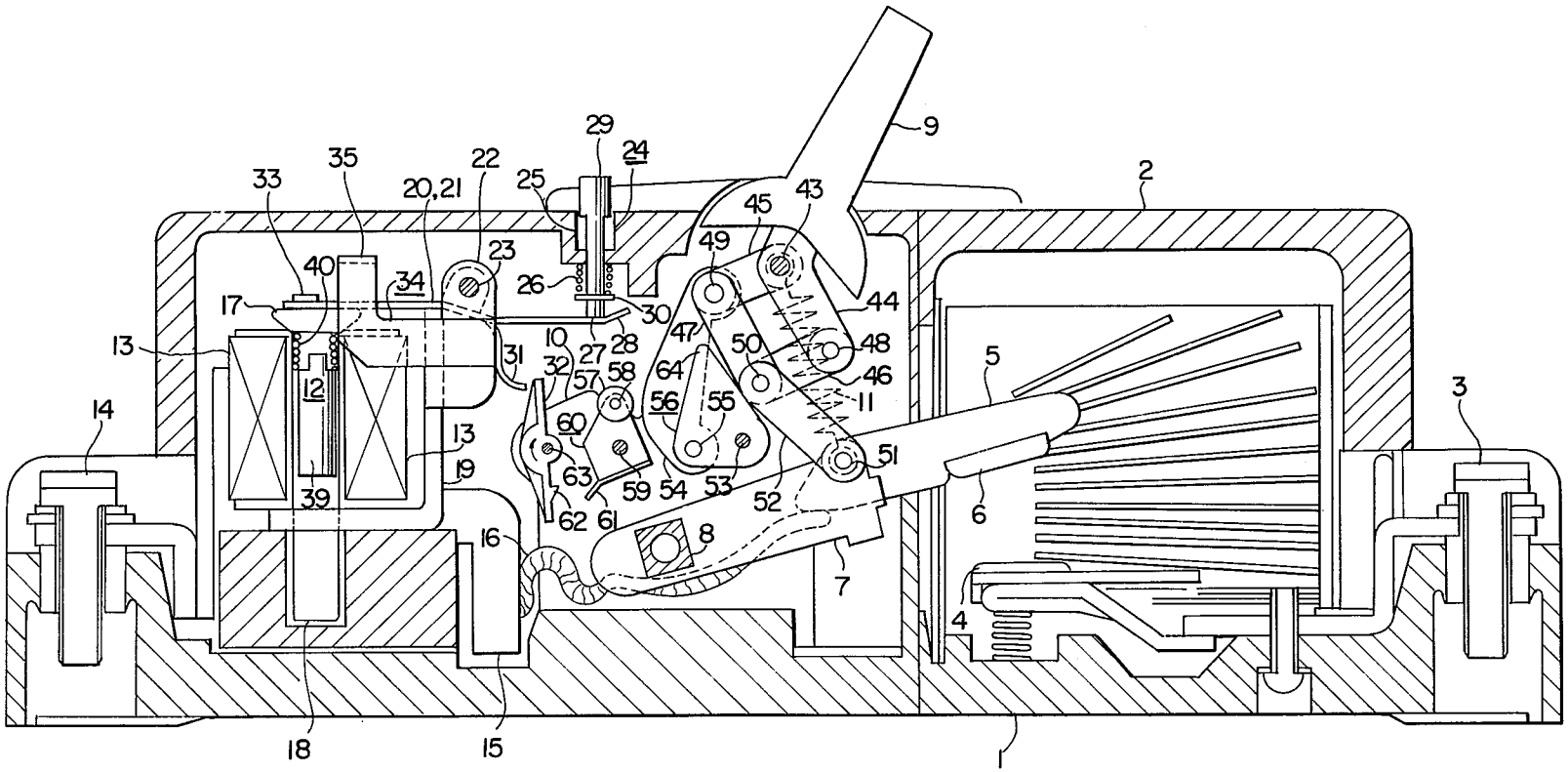
Figure 4:
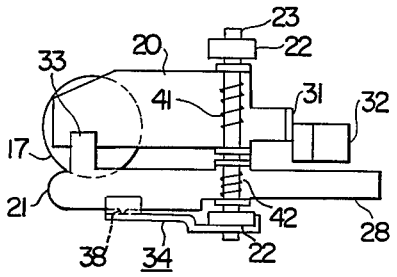
FIG. 4 is a plan view of a current sensor unit.

Referring to FIGS. 1, 2 and 3 each showing a longitudinal sectional view of a circuit breaker embodying the invention, reference numeral 1 designates a mold base, 2 a mold cover, 3 a power source terminal, 4 a stationary contact connected to the power source terminal 3, 5 a movable contact lever, 6 a movable contact secured to the tip of the movable contact lever 5 and permitted to come in contact with the stationary contact 4, 7 a movable lever supported by a multiple pole connection crossbar shaft 8 and connected with the movable contact lever 5 through a shaft 51, 9 a handle mounted on a shaft 43 which is journaled on a main frame 10, 11 a breaking spring for biasing the movable contact lever 5, and 12 a current sensor unit including a pipe 18 of a non-magnetic material and a coil 13 wound thereabout, the coil 13 having one end connected with the movable contact lever 5 through a conductor 15 and a flexible conductor 16 and the other end connected with a load terminal 14. The non-magnetic pipe 18 hermetically confining therein, as well known, a viscous oil in which a plunger 39 and a spring 40 are immersed passes through a hole formed in the bottom of an L-shaped magnetic frame 19. The top end of the non-magnetic pipe 18 is inserted with a magnetic pole piece 17. A movable overload iron plate 20 and a movable short-circuit iron plate 21 are supported at their longitudinally intermediate portions by means of a common shaft 23 journaled on a metal bearing block 22 of a non-magnetic material secured to an upright portion of the magnetic frame 19 such that one end of respective movable overload and short-circuit plates 20 and 21 opposes the magnetic pole piece 17. Further, the movable overload iron plate 20 and the movable short-circuit iron plate 21 are respectively biased by coiled springs 41 and 42 as shown in FIG. 4 in the clockwise direction as viewed from FIG. 1. Numeral 24 designates a short-circuit indicating button inserted into a shouldered hole 25 formed in the mold cover 2. The short-circuit indicating button is biased downward by means of a spring 26 disposed between a stopper ring 30 secured to its lower end portion and the mold cover 2 with its lower end surface 27 engaged with a hinge 28 extending from the other end of the movable short-circuit iron plate 21, so that the top 29 of the button is normally substantially flush with the top of the mold cover 2. Numeral 31 designates a trip piece extending from the other end of the movable overload iron plate 20 and engaging one end of a rotatable multiple pole connection mold 32 mounted on a shaft 63 which is journaled on the main frame 10. The rotatable multiple pole connection mold 32 is biased by a spring not shown in the counterclockwise direction as viewed from FIG. 1.

Numeral 44 designates a first link integral with the handle 9 and mounted on the handle shaft 43 which is journaled on the main frame 10, 45 a second link having one end rotatably mounted on the shaft 43, 46 a third link having one end connected with the other end of the first link 44 by means of a pin 48, 47 a fourth link having one end connected with the other end of the second link 45 by means of a pin 49. The other end of each of the third and fourth links is put together by a pin 50. Thus, the first to fourth linkes cooperate to establish a pantograph configuration. Numeral 52 designates a first connecting link for bridging the shaft 51 adapted to connect the movable contact lever 5 to the movable lever 7 and the pin 50 adapted to connect the third link to the fourth link. The breaking spring 11 is applied across the handle shaft 43 and the connecting shaft 51. The pantograph consisting of the first to fourth links cooperate with the first connecting link 52 to establish a toggle mechanism. A trigger plate 60 is supported by a shaft 59 which is journaled on the main frame 10 and biased by a spring not shown in the counterclockwise direction. The trigger plate 60 has at its lower portion a bent pawl 61 engaging a projection 62 of the multiple pole connection mold 32 and at its upper portion a roller 57 which is supported by a pin 58. Numeral 56 designates a triangular hook mounted on a shaft 53 which is journaled on the main frame 10, and 54 a second connecting link for bridging the pin 49 adapted to connect the second link 45 to the fourth link 47 and a pin 55 fixed to the hook 56. In order to have the circuit breaker closed, as shown in FIG. 1, the bent pawl 61 of trigger plate 60 engages the projection 62 of multiple pole connection mold 32 and an upper pointed portion 64 of the hook 56 engages the roller 57 provided at the trigger plate 60, so that the toggle link mechanism maintains the movable lever 7 at the position shown in FIG. 1 against the biasing force of the breaking spring 11, thereby bringing the movable contact 6 into contact with the stationary contact 4.

Figure 5:
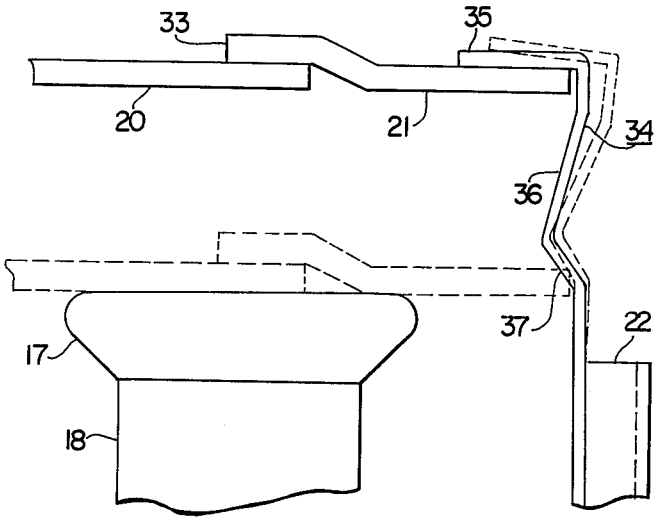
FIG. 5 is an enlarged diagrammatic representation useful to explain the operation of a leaf spring for locking a movable short-circuit iron plate.

Turning now to FIGS. 4 and 5, the one end of the movable overload iron plate 20 opposes almost entirety of the surface of the magnetic pole piece 17 whereas the one end of the movable short-circuit iron plate 21 does so partially. The movable short-circuit iron plate 21 is provided with a tab 33 for pressing down the one end of the movable overload iron plate 20 together upon the attraction of the one end of the movable short-circuit iron plate 21 by the magnetic pole piece 17. A reference numeral 34 designates a leaf spring secured to the non-magnetic metal bearing block 22 and adapted to lock the movable short-circuit iron plate. The leaf spring 34 includes, as shown in FIG. 5, a bent stopper portion 35 which is normally self-biased on account of resiliency to hold the movable short-circuit iron plate 21 prone to turn upward with the lower surface of the bent stopper portion 35 as viewed from FIG. 5, and a bent portion 36 for effecting a toggle action in the process of the movement of the movable short-circuit iron plate 21 to the magnetic pole piece responding to the application of an attraction force caused by the magnetic pole piece 17. In order that the circuit breaker is turned off in the event of short-circuit, the one end of the movable short-circuit iron plate 21 is attracted to the magnetic pole piece 17 with the one end of the movable overload iron plate 20 pressed down by the tab 33 and after the one end of the movable short-circuit iron plate 21 has reached a shallow 37 via a swell of the bent portion 36, the locking leaf spring 34, because of its self-bias resiliency, holds down the one end of the movable short-circuit iron plate even after disappearance of the short-circuit, as shown in FIG. 5 with dotted lines. The movable short-circuit iron plate 21 is also provided with a rounded projection 38 (FIG. 4) which confronts the bent portion 36 of the locking leaf spring 34 for the purpose of smoothly effecting such a turn-off operation in the event of short-circuit as described just above.

In operation, when the handle 9 in the state of FIG. 1 is turned counterclockwise as viewed from the same figure so as to be transferred to the state of FIG. 2, connecting relationships between the multiple pole connection mold 32 and the trigger plate 60 as well as between the trigger plate 60 and the hook 56 are kept unchanged but the configuration of the pantograph consisting of the first to fourth links is deformed. It follows, therefore, that the movable lever 7 and the movable contact lever 5 are pulled up to separate the movable contact 6 from the stationary contact 4, thereby turning off the circuit breaker.

When an overload current flows through the coil 13 of the circuit breaker shown in FIG. 1 thereby generating a first magnetic force at the current sensor unit 12, the plunger 39 of the current sensor unit 12 is gradually raised against the plunger spring 40 and viscous oil in response to the first magnetic force until it is seized by the magnetic pole piece 17 in a well-known manner. Then, only the movable overload iron plate 20 is attracted to the magnetic pole piece 17 as being turned about the shaft 23 counterclockwise as viewed from FIG. 1 to be seized at the magnetic pole piece 17. As a result, the trip piece 31 strikes the one end of the multiple pole connection mold 32, turning it clockwise about the shaft 63. Concurrently therewith, the bent pawl 61 of the trigger plate 60 is disengaged from the projection 62 of the multiple pole connecting mold 32 so that the trigger plate 60 is turned counterclockwise about the shaft 59 to disengage the upper pointed portion 64 of the hook 56 from the roller 57 provided for the trigger plate 60, thereby making inoperative the toggle link mechanism. Eventually, the breaking spring 11 causes the movable lever 7 and the movable contact lever 5 to turn counterclockwise about the crossbar shaft 8 to separate the movable contact 6 from the stationary contact 4, resulting turning-off of the circuit breaker.

When the overload current disappears, the movable overload iron plate 20 is automatically reset by the spring 41 and the trip piece 31 leaves from the multiple pole connection mold 32. Then the multiple pole connecting mold 32 and the trigger plate 60 are turned by springs not shown counterclockwise and clockwise, respectively, and the bent pawl 61 of trigger plate 60 is displaced to a position at which it is ready for engaging the projection 62 of connecting mold 32. Under this condition, by turning the handle 9 counterclockwise, the second connecting link 54 is caused to turn the pin 55 of hook 56 counterclockwise about the shaft 53 while pulling it down and accordingly, the upper pointed portion 64 of the hook 56 is placed in a condition for engagement with the roller 57 provided for the trigger plate 60. Now, as the handle 9 is turned clockwise, the upper pointed portion 64 of hook 56 is brought into engagement with the roller 57 for the trigger plate 60 and at the same time, the bent pawl 61 of trigger plate 60 is also brought into engagement with the projection 62 of multiple pole connecting mold 32, thus recovering the same turned-off or open state of circuit breaker as effected by manually throwing the handle 9 for turning off the circuit breaker. By further turning the handle 9 in the clockwise direction, the pantograph of the first to fourth links is deformed while expanding the breaking spring 11 and causing the first connecting link 52 to turn the movable lever 7 and the movable contact lever 5 clockwise about the crossbar shaft 8, thereby bringing the movable contact 6 into contact with the stationary contact 4 to close the circuit.

In the event of a short-circuit current flow through the circuit breaker, there occurs so a highly intersitive second magnetic force in the current sensor unit 12 that both the movable overload current iron plate 20 and movable short-circuit iron plate 21 are instantaneously attracted and seized at the magnetic pole piece 17 before the elevation of the plunger 39 has been completed. Thus, the trip piece 31 strikes the multiple pole connection mold 32 to turn off the circuit breaker in a similar manner to that for overload current. Concurrently, the hinge 28 of the movable short-circuit iron plate 21 raises the short-circuit indicating button 24 to a level as shown in FIG. 3 to indicate that the turning-off of circuit breaker is caused by the short-circuit. Once attracted, the movable short-circuit iron plate 21 remains locked by pressing it down by means of the locking leaf spring 34 which is self-biased on account of its resiliency. Accordingly, even after disappearance of the short-circuit, the short-circuit indicating button 24, on one hand, keeps projecting from the top of the mold cover 2 and on the other hand, the movable overload iron plate 20 is held down by the tab 33 of movable short-circuit iron plate 21 to continue causing the trip piece 31 to press against the multiple pole connection mold 32. In consequence, the engagement of the mold 32 with the toggle link structure for actuating the movable contact lever 7 remains disenable so that the handle 9 may be thrown on in vain thereby to prevent the reactuation thereof.

Next, when it is desired to close again the circuit breaker following removal of causes for short-circuit in the circuit in question, the short-circuit indicating button 24 now being projecting from the top of the mold cover 2 is depressed to move the one end of the movable short-circuit iron plate 21 upward beyond the swell of the bent portion 36 of locking leaf spring 34 with the result that the iron plate 21 is turned clockwise by the action of the spring 42 to return to the bent stopper portion 35 of locking leaf spring 34. This separates the trip piece 31 from the multiple pole connection mold 32 which in turn is reset by the engagement with the toggle link structure through the pawl. In this manner, the handle 9 is permitted to be thrown on to close the circuit breaker.

While, in the foregoing description, one embodiment has been explained by way of a single-phase circuit, the invention has applicability to multiple-phase circuits. In the application to a multiple-phase circuit, for each phase, a current sensor unit, a movable overload iron plate, a movable short-circuit iron plate, a short-circuit indicating button and the like member may be provided and in common to each phase, a rotatable multiple pole connection mold and a toggle link mechanism, wherein interphase short-circuits and ground-phase short circuits are independently indicated and all of the phases are broken when an interphase short-circuit between any two phases is detected.

Namely, in another embodiment, a multiphase power source is connected to at least three power source terminals which are correspondingly connected to at least three stationary contacts. Each of the stationary contacts normally contacts with corresponding one of at least three movable contacts. At least three current sensor units are provided each including a magnetic pole piece and a coil wound around the magnetic pole piece and connected to the corresponding movable contact and load terminal. At least three pairs of a movable overload iron plate and a movable short-circuit iron plate are provided each corresponding to one of the current sensor units. One end of each of the movable overload iron plates opposes to the corresponding magnetic pole piece and the other ends of the movable overload iron plates engages with a common rotatable multiple pole connection mold. One end of each of the movable short-circuit iron plates opposes a part of the corresponding magnetic pole piece and the other ends of the movable short-circuit iron plates correspondingly engage with at least three short-circuit indicating buttons. Further at least three blocking leaf springs are provided correspondingly to the current sensor units.

I claim:

1. A circuit breaker comprising:

terminal means for receiving a power source;

stationary contact means connected to said power source terminal means;

load terminal means;

a movable lever swingably supported at a portion thereof to move between a first and a second position and having movable contact means disposed on one free end of the movable lever, said movable contact means being movable between said first position at which said movable contact means is brought into contact with said stationary contact means and said second position at which said movable contact means separates from said stationary contact means;

bias means for biasing said movable lever at said second position;

means for normally urging said movable lever toward said first position against said bias means;

current sensing means for producing a first signal by detecting an overload current and a second signal by detecting a short-circuit current;

overload current responsive means actuated in response to said first signal to render inoperable said urging means to thereby displace said movable lever to said second position and automatically deactuated in response to the disappearance of said first signal;

short-circuit current responsive means for actuating said overload current responsive means in response to said second signal, said short circuit current responsive means being deactuated automatically in response to the disappearance of said second signal;

short-circuit indicating means for effecting a short-circuit indication automatically in response to the actuation of said short-circuit current responsive means, said short-circuit indicating means being resettable manually thereby removing said short-circuit indication; and holding means for holding the actuation of said short-circuit current responsive means in response to the actuation of said short-circuit current responsive means, said holding means releasing the holding of said actuation of said short-circuit current responsive means in response to the resetting of said short-circuit indicating means.

2. The circuit breaker according to claim 1, wherein said current sensing means includes a magnetic pole piece and a coil wound around the magnetic pole piece and having connections to said movable contact means and said load terminal means, thereby said current sensing means producing a first magnetic flux in response to an overload current flowing through the coil and a second magnetic flux in response to a short-circuit current flowing through the coil.

3. The circuit breaker according to claim 2, wherein said overload current responsive means includes a first movable iron plate, said first movable iron plate being actuated in response to said first magnetic flux to render invalid said urging means thereby to displace said movable lever at said second position and automatically deactuated in response to disappearance of said first magnetic flux, and said short-circuit current responsive means includes a second movable iron plate, said second movable iron plate actuating said first movable iron plate in response to said second magnetic flux.

4. The circuit breaker according to claim 3, wherein said holding means holds said second movable iron plate once actuated in its actuated position.

5. The circuit breaker according to claim 4, wherein said short-circuit indicating means includes a short-circuit indicating member and a spring member for normally biasing the short-circuit indicating member to a position at which a short-circuit indication is not effected, said short-circuit indicating member moved in response to the actuation of said second movable iron plate against the biasing force of said spring member to effect a short-circuit indication.

6. The circuit breaker according to claim 5, wherein said first movable iron plate is rotatably mounted at a longitudinal intermediate portion thereof and having one end which is opposed to said magnetic pole piece and which is biased by a first spring to normally separate from said magnetic pole piece with the other end engaged with said urging means, said first movable iron plate being turned in response to said first magnetic flux against said first spring with the one end attracted and adhering to said magnetic pole piece and with the other end moved to render invalid said urging means, and said second movable iron plate is rotatably mounted at a longitudinal intermediate portion thereof and having one end which is opposed to said magnetic pole piece in part, which is provided with a tab member opposed to the one end of said first movable iron plate and which is biased by a second spring to normally separate from said magnetic pole piece, said second movable iron plate being turned in response to said second magnetic flux with the tab member attracted and seized by said magnetic pole piece while pressing down the one end of said first movable iron plate.

7. The circuit breaker according to claim 6, wherein said short-circuit indicating member is engaged with the other end of said second movable iron plate and moved in response to the turning of said second movable iron plate against said spring member thereby to effect a short-circuit indication.

8. The circuit breaker according to claim 7, wherein said holding means comprises a leaf spring including a bent portion for effecting positional regulation of said second movable iron plate against said second spring and a swell portion for holding in place the one end of said second movable iron plate when said one end is attracted and adhering to said magnetic pole piece.

9. The circuit breaker according to claim 1, wherein said power source terminal means includes more than two terminals for receiving a multiple-phase power source, said stationary contact means includes more than two stationary contacts connected correspondingly to said power source terminals, said movable contact means includes more than two movable contacts each brought into contact with the corresponding stationary contact at said first position, said current sensing means includes more than two magnetic pole pieces and more than two coils each wound around the corresponding magnetic pole piece and connected to the corresponding movable contact and load terminal, said coils each producing in response to an overload current flowing therethrough a first magnetic flux and is response to a short-circuit current flowing therethrough a second magnetic flux, said overload current responsive means includes more than two first movable iron plates, each of said first movable iron plates being rotatably mounted at a longitudinal intermediate portion thereof and having one end which is opposed to the corresponding magnetic pole piece and which is biased by a first spring to normally separate from the corresponding magnetic pole piece with the other end engaged with said urging means, said first movable iron plate being turned in response to said first magnetic flux of the corresponding coil against said first spring with the one end attracted and adhering to the corresponding magnetic pole piece and with the other end moved to render invalid said urging means thereby to displace said movable lever to said second position, said first movable iron plate being automatically deactuated in response to disappearance of said first magnetic flux, said short-circuit current responsive means includes more than two second movable iron plates, each of said second movable iron plates being rotatably mounted at a longitudinal intermediate portion thereof and having one end which is opposed to the corresponding magnetic pole piece in part, which is provided with a tab member opposed to the one end of the corresponding first movable iron plate and which is biased by a second spring to normally separate from the corresponding magnetic pole piece, said second movable iron plate being turned in response to said second magnetic flux of the corresponding coil with the tab member attracted and adhered to the corresponding magnetic pole piece while pressing down the one end of the corresponding first movable iron plate, said short-circuit indicating means includes more than two short-circuit indicating members and more than two spring members each normally biasing the corresponding short-circuit indicating member to a position at which a short-circuit indication is not effected, each of said short-circuit indicating members being engaged with the other end of the corresponding second movable iron plate and moved in response to the turning of the corresponding second movable against the corresponding spring member thereby to effect a short-circuit indication, said holding means includes more than two leaf springs corresponding to said second movable iron plates, each of said leaf spring including a bent portion for effecting positional regulation of the corresponding second movable iron plate against the corresponding second spring and a swell portion for holding in place the one end of the corresponding second movable iron plate when said one end is attracted and adhering to the corresponding magnetic pole piece.

* * * * *